United States Patent [19]

Bossoutrout et al.

[11] Patent Number: 4,774,506

[45] Date of Patent: Sep. 27, 1988

[54] PROCESS FOR PRODUCING SYNTHETIC VIDEO IMAGES FOR REAL TIME VISUAL DISPLAY AND HIGH INFORMATION DENSITY AND APPARATUS USING THIS PROCESS

[75] Inventors: Pierre Bossoutrout, Margnoc; Luc de Villele, Motgnos, both of France

[73] Assignee: Thomson-CSF, Paris, France

[21] Appl. No.: 783,186

[22] Filed: Oct. 2, 1985

[30] Foreign Application Priority Data

Oct. 5, 1984 [FR] France ..... 84 15329

[51] Int. Cl.[4] ..... G09G 1/16

[52] U.S. Cl. ..... 340/725; 340/747; 340/721

[58] Field of Search ..... 340/725, 721, 747, 745

[56] References Cited

U.S. PATENT DOCUMENTS

| | | | |
|---|---|---|---|
| 4,107,780 | 8/1978 | Grimsdale et al. | 340/721 |
| 4,209,832 | 6/1980 | Gilham et al. | 340/721 |
| 4,498,079 | 2/1985 | Ghosh et al. | 340/725 |
| 4,580,782 | 4/1986 | Ochi | 340/725 |

*Primary Examiner*—Marshall M. Curtis

*Attorney, Agent, or Firm*—Oblon, Fisher, Spivak, McClelland & Maier

[57] ABSTRACT

The process is based on the time-evolutive nature of each of the elements for previously determining a subdivision of the stored image into separate zones, corresponding with the distribution of the elements in the image, and for allocating to each zone a given periodic refreshing rate (between one and N image display cycles) adapted to the evolution characteristics of elements included in the zone in question, so that an integral refreshing of the image is obtained every N cycles.

6 Claims, 3 Drawing Sheets

PROCESS FOR PRODUCING SYNTHETIC VIDEO IMAGES FOR REAL TIME VISUAL DISPLAY AND HIGH INFORMATION DENSITY AND APPARATUS USING THIS PROCESS

BACKGROUND OF THE INVENTION

1. Field of the invention

The present invention relates to a process for producing synthetic video images with a view to a real time visual display with a high information density. The invention also relates to any apparatus using this process. The invention is more particularly intended for use on board aircraft in navigation aid systems utilizing the visual display of symbols on cathode ray tube screens.

2. Prior art

There are various types of synthetic image generators having different performance levels. Among the most efficient, random symbol generators supply sombols in accordance with a random scan. These symbol generators are fast, work in real time, have a good integration and a highly developed software, however, figuring is linear. The other types of generators, such as the commercially available LSI, CAO systems and simulations suffer from disadvantages in certain applications, such as poor representation and large overall dimensions. The hitherto known aircraft-installed synthetic image generators use the random scanning mode the television scan generally being reserved for video image sensors, such as cameras, FLIR, etc.

The object of the invention is to provide a random image generator which, as a result of an image memory, can control visual displays using scans which can be of different types, namely a random scan for which the image generator is provided in a direct link, or other scan types via an image memory, such as framed or so-called television scanning, or matrix scanning.

In the case of an outline by random scanning in real time, the symbol generator has to make the outline again, even if certain figures are fixed or revolve only slowly. The outline is repeated at a frequency compatible with the retinal persistance. For a given scan period corresponding to the duration of an image outline, the capacity of the outline is limited, in view of the fact that for each figure or element which is variable, the calculator has to carry out calculations and indicate at each period the new outline data to the symbol generator. Thus, as the number of figures to be drawn increases, saturation is reached or it is necessary to increase the duration of image drawing. However, this duration cannot exceed the limit compatible with the notion of retinal persistance, i.e. approximately 25 images per second.

In order to obtain a graphic image according to a television scan, it is known to use an image memory and to work according to the so-called double page process, i.e. a first image memory is used on writing, whilst a second image memory is scanned on reading and erased as said reading is carried out and so on, whilst switching the image memories at the end of each reading operation. This solution is disadvantageous in that the memory which is read for the display is erased as matters progress, and all the elements of this memory must then be refreshed by the symbol generator.

According to the invention, the distinction is made between the fixed or slow evolution symbols, which to a certain extent constitute the "decor" and the faster evolution symbols which constitute what is called the "actors". It is proposed to place the decor in one or more image plane. The term image plane is understood to mean a memory means containing all the informations producing an image. The actors are located in one or more other image planes. It is necessary to modify the position of the fast evolution symbols, i.e. the actors as often as possible. Thus, this modification takes place in the timing of the video, i.e. at the image reading rate. However, it is not necessary to modify as frequently the image plane or planes containing the fixed or slow evolution elements constituting the decor, the corresponding refreshing taking place over a longer period. Thus, for each video cycle of reading an image, it is necessary to modify the image plane containing the actors, whilst that containing the decor is only modified during certain cycles or over a certain number of cycles.

The proposed image generator is consequently constituted by a random symbol generating means, specific adaptors, interface circuits, etc., as well as image memories.

This synthetic image generating means has numerous advantages. It makes use of an image generator, e.g. of the VLSI type, which has high performance levels, permits a high volume capacity of graphic descriptions, and has a low consumption level. It also uses all the basic software (assemblers, simulators, use for both framed and random applications). It makes it possible to display framed images, with all the flexibility of random symbol generators (rotation, circle, etc.). The same symbol generator can control in parallel directly the display on screen where the drawing takes place with random scanning, as well as indirectly via image memories, the display on cathode ray tube screens where scanning takes place in framed form. On a television image from a sensor, it makes it possible for "incrustation" to take place with all the flexibility of existing random symbol generators. It uses the same operational software for presenting in certain cases the same images on screens of different types. The figuring normally provided on a display in the random mode can be presented on another display in the framed mode without requiring the program of two different symbol generators. It facilitates reconfiguration in the case of a breakdown.

SUMMARY OF THE INVENTION

The present invention proposes a process for producing synthetic video images with a view to a real time visual display with a high information density, according to which the image is stored, wherein the process takes account of the evolutive nature in time of each of the elements to be displayed and of their respective evolution speed for determining a subdivision of the stored image into separate zones, corresponding with the distribution of said elements in the image and for allocating to each zone a given periodic refreshing rate between an image display cycle and a maximum number of n cycles, said rate being adapted to the evolution characteristics of the elements included in the zone in question, so that the integral refreshing of the image is obtained every n cycles, making it possible to facilitate the writing of the memory during each cycle by selective refreshing, whilst maintaining real time display.

BRIEF DESCRIPTION OF THE DRAWINGS

The invention is described in greater detail hereinafter relative to a non-limitative embodiment and the attached drawings, wherein show.

PREFERRED EMBODIMENTS OF THE INVENTION

Figure 1:
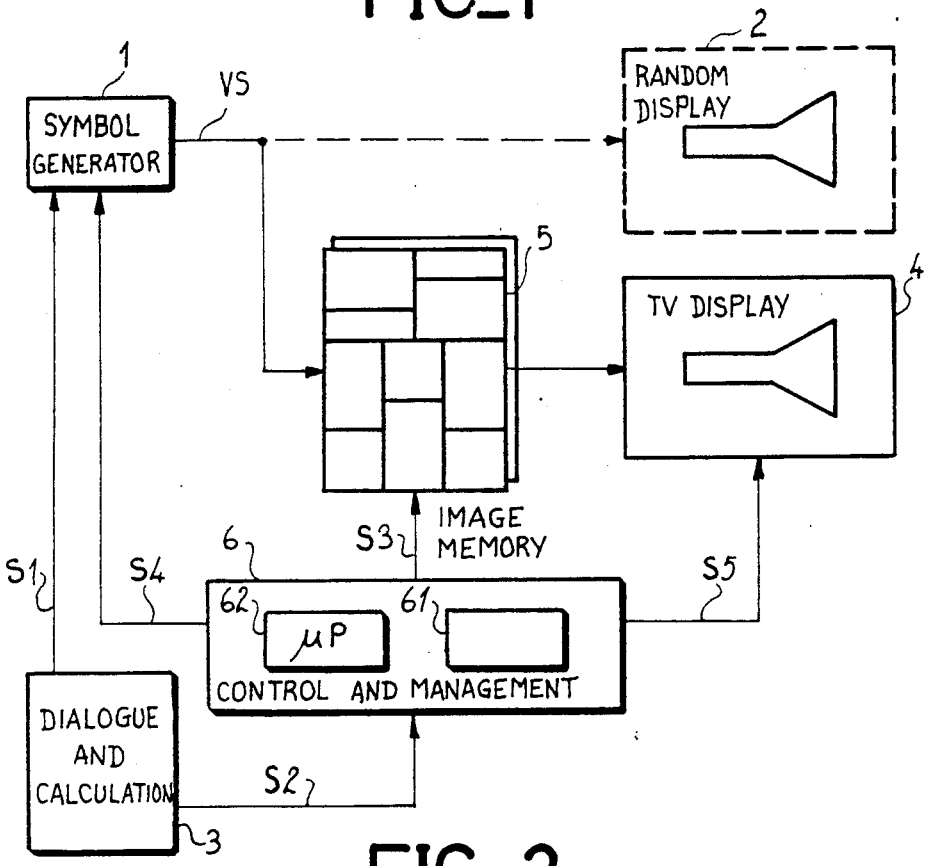
FIG. 1 a general diagram of a synthetic image display means according to the invention.

On referring to FIG. 1, the apparatus comprises a symbol generator circuit 1, of a conventional type supplying synthetic video signals VS for producing an outline in real time in accordance with a random scan. Thus, the synthetic video image is formed on the screen of a cathode ray tube or a display means 2 in accordance with a known procedure. Dialogue and calculation means 3 are normally provided in such a configuration, controlling the symbol generator 2, in order to produce the desired image display for operation and to bring about the evolution or development of said image in a corresponding manner in time. The necessary data are transmitted to generator 1 by link S1.

For producing on the basis of the same signals VS, a synthetic image in accordance with a television or matrix scan, and display an image with a high information density, there is a corresponding display means 4 having a cathode ray tube or matrix panel as well as image storage means 5 interposed between display means 4 and generator 1. However, this does not exclude the possible joint use of the random scan display means 2.

According to the invention, the storage means 5 are arranged in a special manner to provide a high outline capacity and meet fixed criteria formed by an image display with a large number of symbols. As stated hereinbefore, this organization is based on the distinction made between the moving parts, called actors, which represent the evolutive parts and consequently image changing parts, as well as the remaining parts which are fixed and called the decor and in which are also integrated the semi-fixed parts, which have a limited evolution in time. Bearing in mind that the data of these different image parts will vary in a corresponding manner, i.e. rapidly for the moving parts and slowly or not at all for the other parts, it follows that it is possible to determine a subdivision of the image into zones and respectively attribute thereto a refreshing rate appropriate for the evolution of the elements therein.

Figure 2:
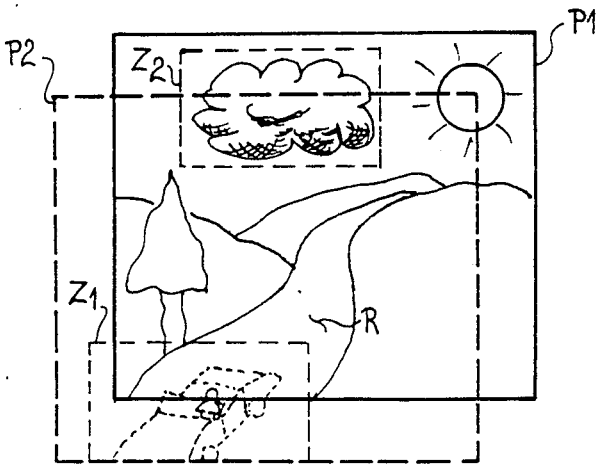
FIG. 2 a synthetic image stored on two planes in accordance with the process used.

It is pointed out that this subdivision is not necessarily fixed and can in itself vary in time, this obviously also applying to the refreshing rates allocated to the zones. In order to facilitate understanding, reference will be made to FIG. 2 showing the image distributed over the two planes, namely a plane P1 representing the decor and a plane P2 representing the actors. In the simple example shown, the decor is considered to be in the form of scenery, which is assumed to be fixed and the actors are constituted by a moving element, such as a vehicle VM, which moves on decor route or road R. As the vehicle moves on said road R, zone Z1 defining the element VM will decrease and will change ever more slowly. Therefore, said zone Z1 containing the moving object VM is considered to have variable dimensions, as well as its refreshing rate. The corresponding variation data are preprogrammed and/or calculated as a function of the evolution provided or measured to permit a visual display matched to reality.

It is also necessary to consider that it is possible to have several operating modes, depending on whether the synthetic image to be represented differs between the individual modes. Other programming arrangements also correspond to this mode parameter. A management and control circuit 6 is provided for producing the sequence of reading, addressing the image memory and selective refreshing, i.e. local writing into the memory. Circuit 6 produces these different functions. From the calculating circuit 3, it receives the operating mode information S2, exchanges with the symbol generator 1 all the data S4 corresponding to the refreshing zones or cycles, link S3 to circuit 5 represents the addressing controls and signals S5 the display control at 4.

The image memory 5 has at least one memory plane for storing the elements forming the image in different zones depending on whether they are elements belonging to the decor or to the actors, and as a function of their evolution speed. Each zone is allocated to a refreshing rate determined as a function of the latter parameter. Thus, the refreshing rates can vary between 1 and n image cycles, the zones forming the actor part being refreshed at the faster rate and that of the image and the decor part zones at slower rates ranging between 2 and N cycles, as a function of the particular case.

However, in order to meet the criteria of large outline capacity and for displaying a large number of symbols, memory 5 is preferably organized with several memory planes, at least one memory plane for containing an image plane limited to the decor and at least one memory plane for storing an image plane corresponding to the actors. Each image plane is coded on one bit, or on several bits if there are several memory planes per image plane. The image plane is subdivided into zones, whose dimensions can be evolutive in time and each of which is allocated a refreshing rate which can also evolve in time.

Figure 3:
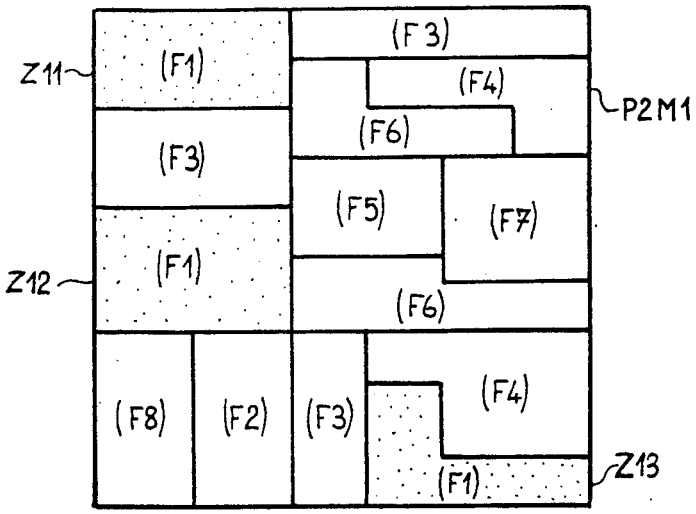
FIG. 3 an example of the zonal distribution of the image with the respective refreshing frequencies.

FIG. 3 shows a subdivision into image zones, where there is e.g. fourteen different zones for the operating period in question and eight separate refreshing frequencies. Frequency F1 corresponds to refreshing at the frame rate, frequency F5 to refreshing every five frames, etc. The different frequencies are designated F1 to F8. The zones of frequency F1 have e.g. been highlighted by dotted lines to show the parts of the image refreshed at this rate. It is obvious that the erasing of a zone is followed by its re-writing, otherwise there is a hole in the configuration. In the example of FIG. 3, consideration has been given to zones coded on three bits, which permits eight refreshing codes. For a coding on four bits there would be sixteen refreshing codes. The zones are defined by rectangular polygons.

In this way a selective refreshing is produced, the circuits used making it unnecessary to entirely refresh the image for each reading on an image plane of the decor. The zones could be defined by a programmable memory or PROM 61, or by a random-access memory or RAM controlled by a microprocessor 62 and having a resolution of a certain number of picture elements, e.g.max. 32 picture elements. It would also be possible to select, via a bus, a certain number of refreshing modes, e.g. 16 modes, corresponding to 16 formats for breaking down into refreshing zones.

Figure 4:
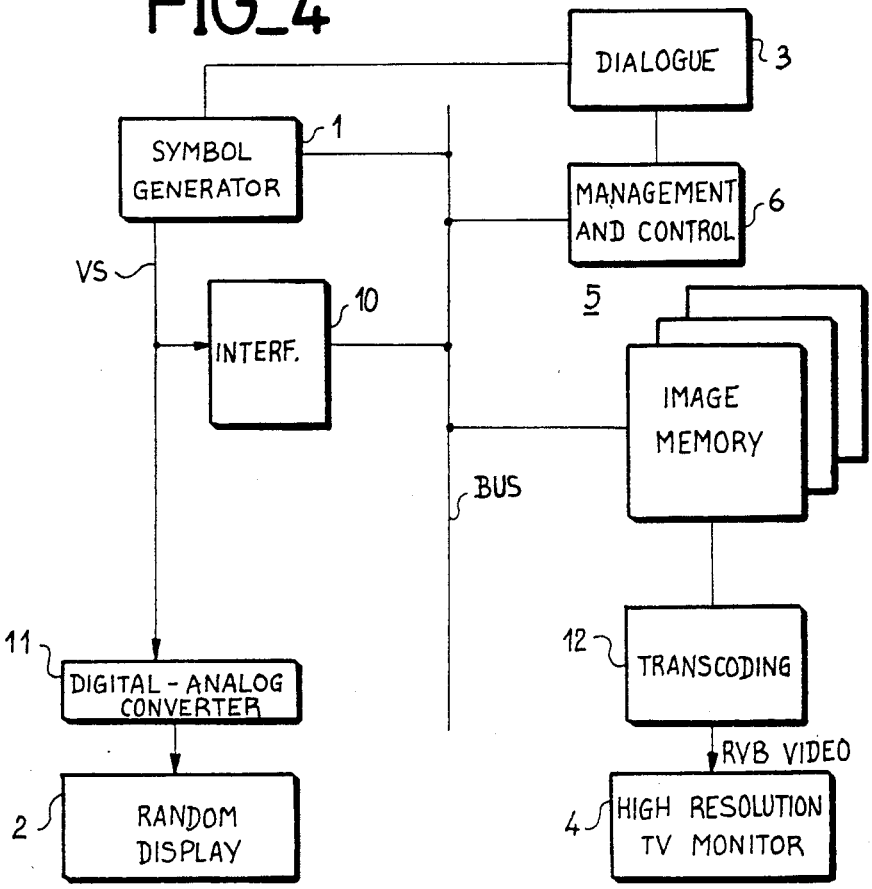
FIG. 4 a diagram of a display means according to the invention permitting random and television displays.

FIG. 4 shows in greater detail the structure of FIG. 1, the means also having an interface circuit 10 receiving from the symbol generator the address data at X and Y and the colour video data from the synthetic video; an image bus; a digital - analog converter 11; as well as a transcoding memory 12 which reproduces from the image memory 5 the video RVB intended for a colour display. In accordance with this configuration, it is possible to simultaneously or non-simultaneously produce two image types, one in random scan on indicator 2 and the other in framed or television scan on indicator 4. For each presentation mode, use is made of the specific possibilities thereof and the means makes it possible on the basis of the same software and the same symbol generator, to make use of the specific advantages of each representation mode.

For example, it can be considered that the integral refreshing of the displayed image, i.e. the actors and decor, takes place at the end of eight image cycles, i.e. eight frame periods. During each of these eight video cycles, the complete image is read, i.e. simultaneously the different decor and actor image planes are read to produce the corresponding display. The zones of the actor image plane are all erased at the image rate, so as to integrally refresh said plane in each image cycle. However, the zones of the decor image plane are erased and refreshed selectively at rates varying between two and eight image cycles. Thus, for each cycle, all the elements of the actor image plane are modified, whilst in the decor image plane a limited number of elements is modified and this corresponds to one or several zones. It is obvious that during each of these cycles, erasure only takes place after reading of the memory elements which would be modified during the following cycle, namely the integrality of the actor image plane and part of the decor image plane. The subdivision of each of the memory image planes into refreshing zones makes it possible to isolate the elements of this plane from one another. Each of these planes is subdivided into elementary surfaces defining the breakdown resolution. Each refreshing zone has one or more non-contiguous elementary surfaces. The same refreshing zone cannot have several elements with different refreshing cycles.

Figure 5:
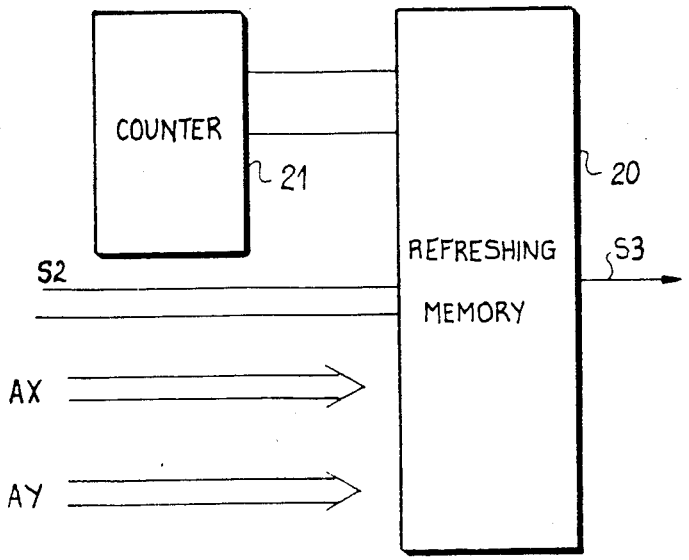
FIG. 5 a simplified diagram of the circuits used for refreshing.

FIG. 5 diagrammatically shows the means included in the management and control circuits and used for refreshing the image memory 5. These refreshing means comprise a refreshing memory 20 and a video cycle counter 21, which at the output supplies the cycle number information. In addition, the refreshing memory receives the indication S2 of the type of refreshing program and the addresses AX of reading the X and AY of reading at Y, to which an elementary surface corresponds on each occasion. The refreshing memory 20 supplies an erase instruction corresponding S3 to the image memory. The refreshing memory 20 contains for each elementary surface the refreshing cycle number or numbers of the zone in question. This memory is read synchronously with the image memory and gives the erase instruction of the image memory. The refreshing memory can be chosen in such a way that it can reproduce the configurations of zones per program, e.g. on mode change. The program of the symbol generator works on multiple cycles of the video and can manage the different symbols in time.

Figure 6:
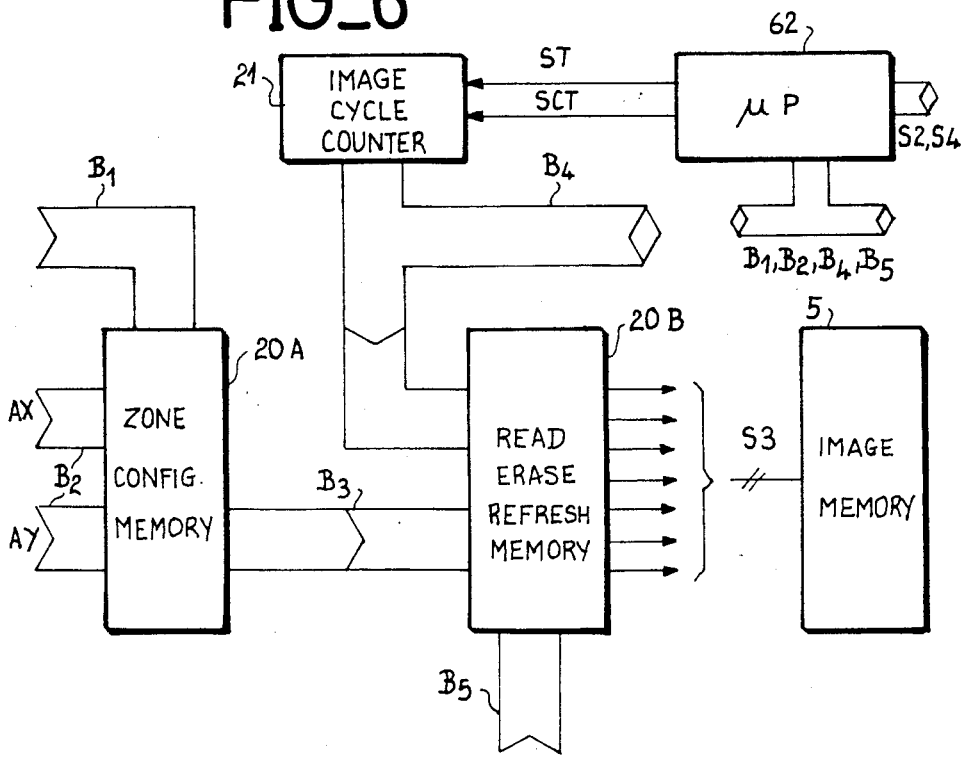
FIG. 6 a diagram of the embodiment of the refreshing circuits.

FIG. 6 shows in more detail the embodiment of the aforementioned refreshing circuits. The refreshing memory 20 comprises elements 20A and 20B. The first memory 20A stores the data defining the configuration of the zones. By a bus B1 this first memory 20A receives coded information defining the zone configuration for the selected operating mode, or for the operating phase taking place (case of the operating mode with time-evolutive zone configuration). The reading addresses AX and AY for the reading are received by link B1. The output B3 of the first memory 20A provides coded information on the zones to be read at the considered time. The information is transmitted to the second memory 20B, which receives from counter 21 the cycle number information, from a bidirectional bus B4 the zone reading control, erase and refreshing informations; and from a bus B5 the information of the image plane to be refreshed. The second memory 20B supplies signals S3 to the image memory 5. Signals B1, B2, B4, B5 can be processed by microprocessor 62 on the basis of informations S2 received by the auxiliary dialogue and calculation means 3 and from the symbol generator 1. In addition, said microprocessor can supply a frame synchronization information ST to the image cycle counter 21, which can be put out of operation by an inhibition control SCT, or so-called three-state control and in this case the symbol generator 1 can ensure the refreshing controls.

The programming in the control and management system 6 can be carried out to define the subdivision into zones both from the standpoint of the position of the zone and in evolutive form thereof and that the duration N or image cycles necessary for the integral refreshing is determined in such a way as to preserve an image display reproducing display conditions in real time or substantially in real time.

What is claimed is:

1. A process for producing a real time visual display of the element of the image, called fast or slow symbols and constituting a synthetic video image having a high information density, said process comprising:

generating synthetic video signals corresponding to said symbols;

storing said synthetic video signal in a memory having at least one image plane;

reading of said memory for display of said stored synthetic video image;

distinguishing between the symbols which present practically no change and have a fixed and substantially low evolution and denominating these symbols as slow symbols and the other symbols of the image which evolve faster and denominating these symbols as fast symbols;

determining, with respect to said distinguishment between said slow and fast symbols, a subdivision of the image and consequently a subdivision of the memory into zones and respectively attributing thereto a periodic refreshing rate, in accordance with the distinctive evolution of the symbols therein;

said zones and refreshing rates being determined according to said respective evolution of said symbols wherein each zone has a periodic refreshing rate selected from between at least one each image display cycle for the symbols of fixed or slow evolution and a maximum number of n times each cycle for the symbols of fast evolution;

matching said rate according to the evolution characteristics of the symbols included in the zone considered so that the integral refreshing of the image is obtained every n cycles, facilitating the writing of the memory during each image display cycle by selective refreshing, while maintaining a real time display; and varying the dimensions of each zone and their respective refreshing frequencies as a function of the evolution of symbols included in said zone.

2. A process according to claim 1, wherein the subdivision of the images into zones takes place on a single memory plane having all the elements of the image.

3. A process according to claim 1, wherein the subdivision of the image into zones takes place on at least two stored image planes, a first image plane having the fixed and slow evolution elements and the second image plane has the remaining elements of the image with a faster evolution.

4. A process according to claim 3, wherein said second image plane is read and refreshed at the image rate and each zone of the first image plane is also read at the image rate but is only refreshed at a higher rate, which is a multiple of the image rate, the refreshing frequency of the first plane varying from two to N cycles and being respectively attributed to the zones in accordance with their respective evolution criterion, the complete first image plane being refreshed after N cycles.

5. A process according to claim 1, wherein said subdivision is predetermined by the selected operating mode and it is modified during the passage to another operating mode, in order to respond to a different distribution of elements to be displayed and therefore the corresponding image zones.

6. A process according to claim 1, wherein the subdivision into zones is programmed for defining both the position and the form of the zones and wherein the duration N of the integral refreshing cycle of the image is determined so as to preserve a display thereof under conditions corresponding to a real time display.

* * * * *